United States Patent [19]

Dumortier

[11] 4,175,781

[45] Nov. 27, 1979

[54] LATCHING ARRANGEMENT FOR MANHOLE COVER

[76] Inventor: Robert Dumortier, 9 rue Duchartre, Beziers (Herault), France

[21] Appl. No.: 866,708

[22] Filed: Jan. 3, 1978

[30] Foreign Application Priority Data

Jan. 5, 1977 [FR] France ..... 77 00650
Nov. 25, 1977 [FR] France ..... 77 36458

[51] Int. Cl.[2] ..... E05C 3/10
[52] U.S. Cl. ..... 292/218; 49/465
[58] Field of Search ..... 292/59, 62, 195, 202, 292/213, 214, 218; 49/465; 70/346, 355

[56] References Cited

U.S. PATENT DOCUMENTS

| | | | |
|---|---|---|---|
| 184,501 | 11/1876 | Bullsley | 292/62 X |
| 213,515 | 3/1879 | Marshall | 70/346 |
| 534,987 | 3/1895 | Alsdorf | 292/262 |
| 852,832 | 5/1907 | Engelquist | 70/346 |
| 1,792,537 | 2/1931 | Irwin | 292/59 X |
| 3,977,124 | 8/1976 | Oger | 49/465 |

*Primary Examiner*—Richard E. Moore
*Attorney, Agent, or Firm*—Karl F. Ross

[57] ABSTRACT

A manhole cover is secured to a support ring by means of a latch member which is rotatable in a cavity formed in the manhole cover between a pair of upper and lower walls having respective upper and lower throughgoing apertures. The latch member is rotatable and has a lower end projecting through the lower aperture and an upper end underneath the upper aperture and formed at the axis of rotation of the latch member with a socket opening toward the upper aperture. The socket in the upper aperture is of similar shape and of like radial extensions. The rim has a formation cooperating with the lower end of the latching member for locking of the cover and the support ring together in a locking angular position of the latching member relative to its rotation axis in permitting separation of the cover and the support ring in an angular offset freeing position. The radial extensions of the socket and upper aperture are axially aligned only in the locking position. The key has the tip of substantially the same cross-sectional shape as the upper aperture and the socket and is engageable through the upper aperture into the socket only in the locking position. The tip of the key is dimensioned so that it is possible to withdraw it from the manhole cover except when the latching member is in the locking position so that this key cannot accidently be taken away before the cover is locked in place.

9 Claims, 9 Drawing Figures

LATCHING ARRANGEMENT FOR MANHOLE COVER

FIELD OF THE INVENTION

The present invention relates to a latching arrangement for securing a cover on a support rim. More particularly this invention relates to a manhole cover and a system for locking it in place.

BACKGROUND OF THE INVENTION

A manhole cover is traditionally formed as a massive cast-iron disk that is received in a support rim embedded in a surface, such as a roadway. As such a cover is extremely heavy it inherently remains well seated on its rim, even when relatively large vehicles pass over it and subject it to considerable vibration.

Recently such cast-iron mahhole cover disks have been replaced with substantially lighter malleable iron steel, or spherolytic (globular) graphite disks which can be produced at considerably lower cost, are much easier to handle, and are physically as strong as the old-fashioned cast-iron disks. Such relatively light disks do pose a difficult problem in that it is necessary positively to lock them in place on the respective rims. Otherwise when subjected to the considerable vibration and external forces to which such a cover is inherently subjected, such manhole covers can come loose, uncovering the relatively large pit underneath them and presenting a considerable danger to traffic.

The commonest method of locking such a manhole cover disk to its rim is simply to provide the disk with a plurality of radially extending bayonet-type projections. The room is correspondingly formed with a plurality of inwardly open recesses so that the cover can be placed on the rim with the projections lying at the recesses, and then rotated to lock the two members together bayonet-fashion. It has also been suggested to provide individual physical latching members that extend from the cover into correspondingly shaped recesses in holes in the rim, and to use a tool or key for relatively rotating the latching members and the hole in the rim so as to lock them together.

Both of these arrangements have the cosiderable disadvantage that the maintenance personnel, after having worked in the manhole pit and replaced the cover, frequently forget to lock it properly in place. Once positioned over the rim there is no way to tell whether the cover is locked in place without trying to pry it up. Thus such a relatively light cover is frequently left merely lying on its rim so that vibration can loosen it and present the above-mentioned traffic hazard.

OBJECTS OF THE INVENTION

It is therefore an object of the present invention to provide an improved latching arrangement usable for securing a manhole cover to a fixed support rim.

Another object is the provision of such a latching arrangement which is relatively easy to use, inexpensive to manufacture, and lockable to prevent the cover and rim from separating unless positively acted on by a person having the appropriate tool.

Yet another object is to provide such a latching arrangement which will effectively remind its user to lock it in place so as to insure that once replaced the manhole is always locked onto its rim.

SUMMARY OF THE INVENTION

These objects are attained according to the present invention in a latching arrangement comprising a cover formed with a cavity and with upper and lower throughgoing apertures opening into the cavity and both lying on a cavity axis. A latch member is rotatable in the cavity about this axis and has a lower end which projects to the lower aperture and an upper end underneath the upper aperture and formed at the axis with a socket opening toward the upper aperture. The socket and the upper aperture are both of similar shape and have like radial extensions. A support rim has a seat snugly engageable with the cover and provided with means having a formation cooperating with the lower end of the latching member for locking the cover and support together in a locking angular position of the latching member relative to the axis, and for permitting separation of the cover and the support in an angularly offset freeing position of the latching member relaitive to the support. The extensions of the upper aperture and of the socket are axially aligned only in the locking position of the latch member. A key has a tip of substantially the same cross-sectional shape as the upper aperture and the socket and is engageable through the upper aperture into the socket only in the locking position of the latching member.

Thus only when the socket and the upper aperture are aligned, that is only when the cover is locked to the support rim, can the key trip through the upper aperture into the socket for rotating the latching member and unlocking the device, or for withdrawal of the key through the upper aperture into the socket for rotating the latching member and unlocking the device, or for withdrawal of the key through the upper aperture.

According to a further feature of this invention the distance between the upper end of the latching member and the lower surface of the cover at the upper aperture is shorter than the overall axial height of the tip of the key, so that it is absolutely impossible to withdraw the key from the upper aperture until the socket and upper aperture are aligned in the position in which the cover and rim are locked together. In this position the key also provides a very convenient handle by means of which the cover can be lifted off the rim. Furthermore once the disk is installed the maintenance personnel will only be able to recover their tools by locking the cover in place, and until this is done the tool will remain projecting upwardly out of the cover so as to provide an excellent reminder to the maintenance personnel that the cover is not locked in place.

According to this invention the lower end of the key is formed with at least one radial projection of substantially the same shape as the radial extensions of the upper aperture and the socket. Two diametrically opposite tongues may constitute this projection, or a single T-shape tongue if desired.

According to yet another feature of this invention the arrangement includes a plug having an upper portion of substantially the same cross-sectional shape as the upper aperture and a lower portion of substantially the same cross-sectional shape as the socket, and having an overall height equal to the distance between the base of the socket and the upper surface of the cover at the upper aperture. Once the cover is locked in place this element serves to block the hole in the cover and to angularly lock the latching member on the cover. Such a plug may be provided with radially extending teeth that hold it tightly in the upper aperture and socket, or that engage under the upper surface of the cover. Furthermore the plug can be provided with one or more radial formations, in the form of radially opening recesses or projections, under which can sit a hook provided on the opening tool. To this end the upper surface of the cover at the upper aperture is chamfered, or at least provided with a groove alignable with each of these projections.

In the discussion above and below the terms "upper" and "lower" are used merely for convenience, it being understood that the latching arrangement according to this invention could be used on a vertical surface, or upside-down from the orientation described herein below.

SPECIFIC DESCRIPTION

Figure 1:
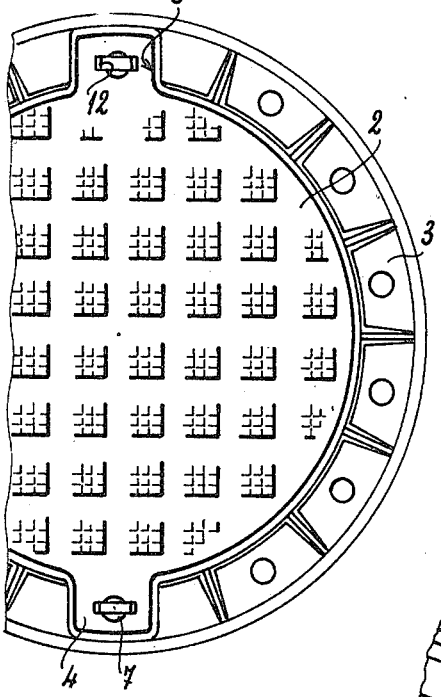
FIG. 1 is top view of a manhole cover embodying the latching arrangements according to this invention.

As shown in FIGS. 1–4 the arrangement according to the instant invention basically comprises a manhole-cover disk 2 supported on a face ring or rim 3. The cover has a pair of diametrically opposite radially extensions 4 received in correspondingly situated cavities or recesses 5 of the ring 3. Thus these projections 4 determine the angular position of the disk relative to the rim 3.

Each of the projections 4 defines a chamber or recess 6 having a lower wall 6*a* spaced above a rim 3*a* of the support ring 3 and a top wall 6–10. Received within this chamber is a cylindrical portion 7 of a latching member 18 having a cylindrical shaft 8 extending downwardly through a cylindrical lower aperture 17 in the lower wall 6*a*.

The rim 3*a* of the base ring 3 is formed with an elongated slot or throughgoing hole 9 having a chamfered upper edge and extending in a direction radial of the disk 2. The lower shaft 8 of the latching member 18 carries a pair of diametrically opposite formations or tongues 10 engageable under helical ramps 11 provided on the bottom face of the rim 3*a* to each side of the hole 9.

The upper wall 12 is formed with a throughgoing elongated slot 12 extending perpendicular to the elongated hole 9. The entire latching member 18 is rotatable relative to the cover 2 about an axis A which passes through the two holes 9 and 12.

An opening key or tool 19 has a shaft 14 on the lower end of which is provided a formation in the form of two diametrically oppositely extending tongues 13 snugly engageable in correspondingly shaped recess 16 on the top surface of the portion 7 of the latching member 18. At its upper end the shaft 14 of the key 19 has a cross-piece or handle 15. The groove 16 extends parallel to the tongues 10.

Figure 3:
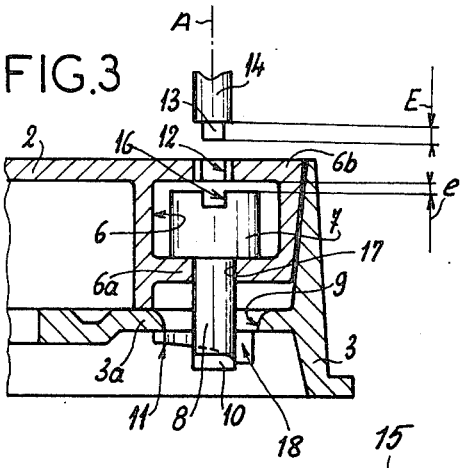
FIG. 3 is an axial section taken through the detail of FIG. 2.

FIG. 3 shows how the cover 2 is locked to the base ring 3 with the shaft 8 extending through the hole 9 and the tongues 10 bearing upwardly against the ramps 11 so as to pull this cover 2 tightly down on the ring 3. In this position the elongated slot 12, groove 16, and tongues 10 all extend parallel to each other. It is therefore possible as also shown in FIG. 3 to insert the tool 19 through the slot 12 so that the tongues 13 can fit into the groove 16.

Figure 2:
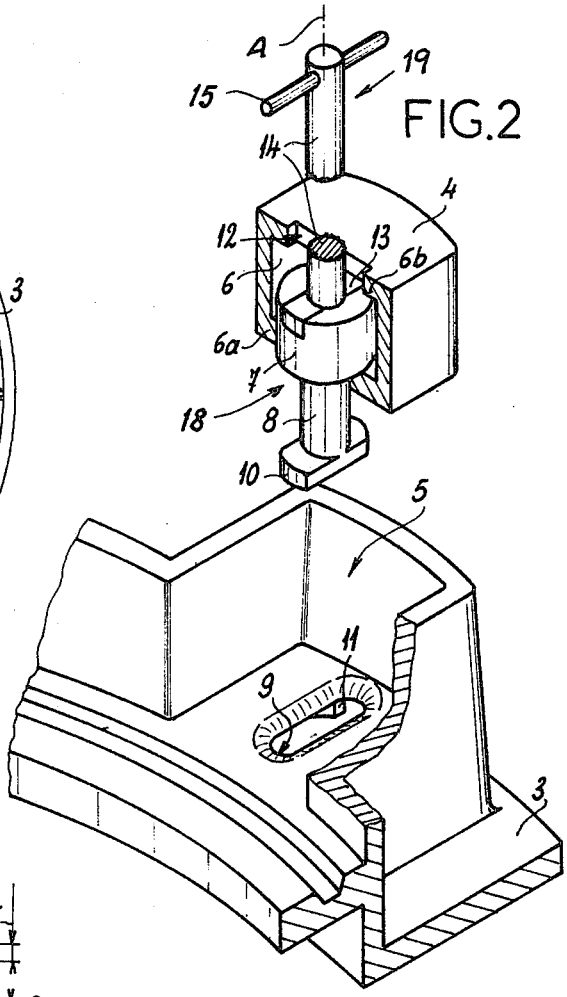
FIG. 2 is a large-scale perspective sectional of the detail of the structure of FIG. 1.
Figure 4:
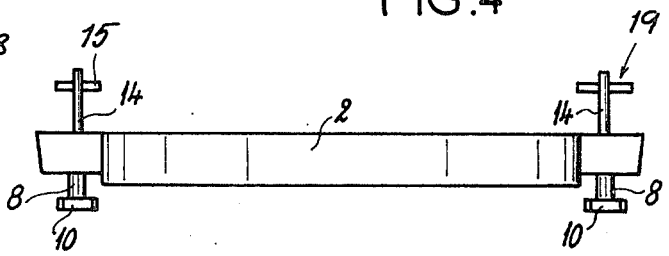
FIG. 4 is an edge view of a manhole cover according to this invention.
Figure 5:
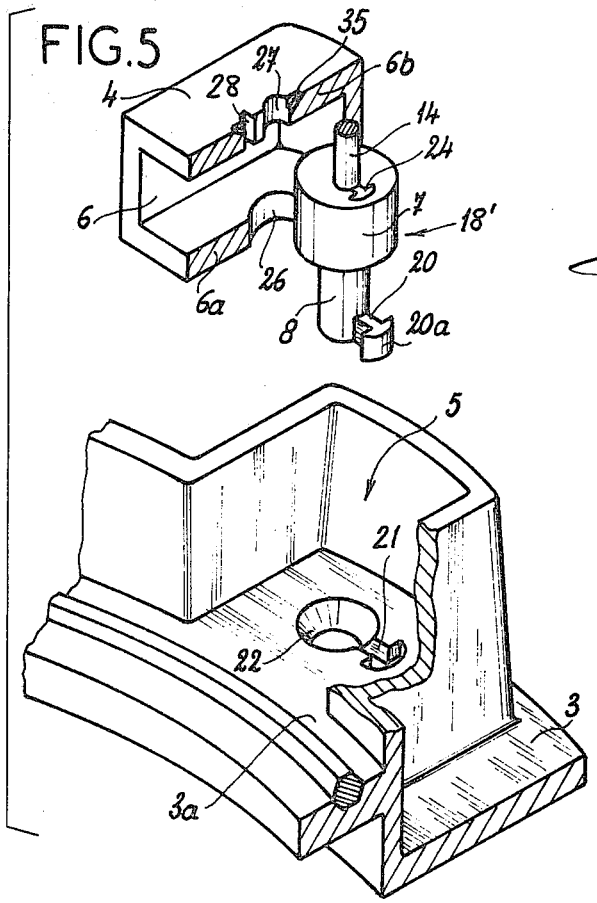
FIG. 5 is similar to FIG. 2 illustrating another arrangement according to this invention.
Figure 6:
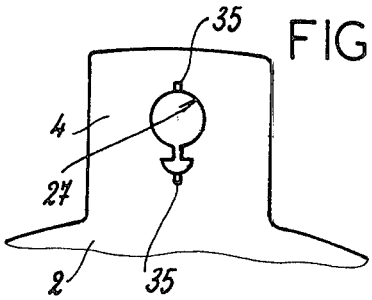
FIG. 6 is a top view of the arrangement of FIG. 5.

Thereafter as shown in FIG. 2 the tool 19 and with it the latching member 18 can be rotated through 90° so as to align the two tongues 10 with the elongated slot 9 and allow the cover disk 2 to be lifted off the ring 3. The tongues 13 of the tool 19 are perpendicular to the slot 12 so that it will be possible for the user to lift the cover 2 by means of the handle 15 as indicated in FIG. 4.

The distance e between the upper surface of the latching member 18 and the bottom surface of the upper wall 60 is substantially smaller than the height E of the formations 13 on the tool 19. Thus it is impossible to withdraw the tool 19 through the hole 12 unless the groove 16 is aligned with the hole 12. Once the cover 2 has been replaced on the ring 3 it is impossible to remove the tool 19 from it without rotating the latching members 18 into the position corresponding to the locked position of the cover 2 on the ring 3. The upwardly projecting tool 19 will serve as an excellent reminder for the user that the cover 2 is not locked, and only by recovery of the tool 19 can the cover 2 be locked in place. The possibility of forgetting to secure the cover 2 positively in place is entirely ruled out, while at the same time the unlocking tool provides a useful handle for removal of the cover 2.

FIGS. 5–9 show another arrangement where a functionally identical structure has the same reference numerals as in FIGS. 1–4.

Figure 9:
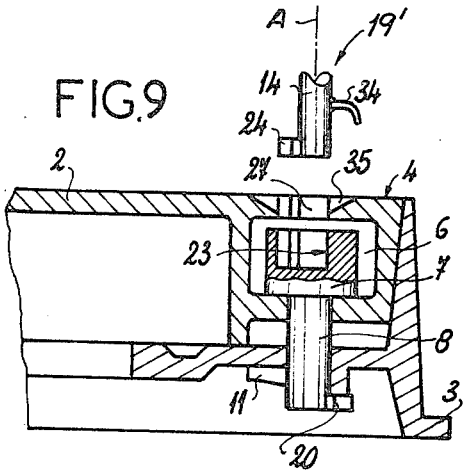

Here, however, a latch member 18′ is provided having, instead of the formations 10, a single radial projection 20 of T-shape and having a semicircular end portion 20*a*. The support ring 4 is formed with an upwardly chamfered hole 22 having an extension 21 of the same shape as the projection 20 and provided with a single ramp 11 as shown in FIG. 9.

The upper portion 7 of the latching member 18′ is formed with a socket 23 having a radial projection 24 which of substantially the same shape as the projection 20 and angularly pointing in the same direction from the axis A. The upper wall 6*b* of the chamber 6 has a hole 27 of identical shape, that is with an extension 28 of the same shape as the extension 23, 21, and 24.

Figure 7:
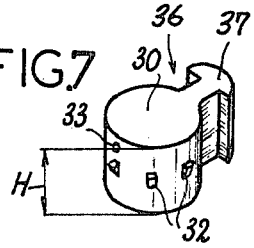
FIG. 7 is a perspective view of an element of the arrangement of FIG. 5.
Figure 8:
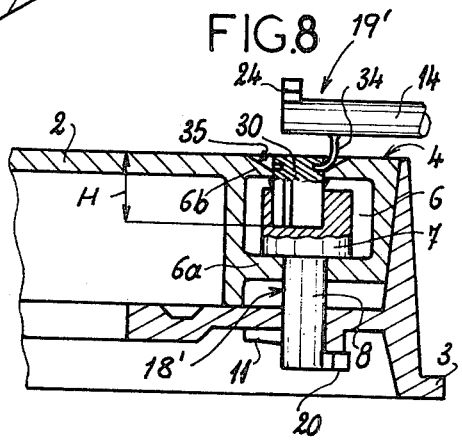
FIGS. 8 and 9 are axial sections showing the latching arrangement according to this invention in successive stages of use.

For this arrangement it is possible to lock the assembly tightly in place by means of a plug 36 illustrated in FIG. 7 and having an extension 37 of the same shape as the extension 24 and 28, and having a cylindrical body 30 snugly fittable in the socket 23 and hole 27. In addition this plug 36 has a height H equal to the distance between the bottom of the socket 23 and the upper surface of the cover 2. Thus when driven into these aligned recesses 27 and 23 as illustrated in FIG. 8 the plug 36 will lock the latch member 18′ in its locked position. From accident service life the plug is made of synthetic-resin material, and has small teeth or barbs 32 that engage under the upper wall 6*b* of the cover 2 to prevent vibration from loosening the plug 36. At the same time the plug 36 is formed at its opposite sides with small recesses 33 which are aligned with corresponding grooves 35 on the cover 2 so that a hook 34 on the tool 19' can be engaged in them to pry the plug 36 out.

Thus when a user wants to remove the cover 2 he first places the hook 34 in the recesses 33 to pry out the plug 36, then fits the tip of the tool 19' with its projection 24 into the socket 23 to rotate the latch member 18' as described above with reference to FIGS. 1–4. Once again as soon as the latch member 18' is moved our of the locking position it becomes to withdraw the tool 19' from the latch member 18' so that the above-described security features are once again present.

It is of course possible to alter the structure above without departing from the scope of the invention, as for instance by using the formations of the embodiment of FIGS. 5–9 in the arrangement of FIGS. 1–4 or vice versa. The recesses 33 could be replaced by a circumferential groove and the grooves 35 by a simple chamfer if desired. Furthermore the particular locking arrangement with the ramps 11 could be provided on the upper surface rather than the lower surface of the rim 3*a*. All such modifications within the abilities of a person skilled in the art are deemed to be covered by the hereto attached claims.

I claim:

1. A latching arrangement for a manhole, said arrangement comprising:

a disk-shaped manhole cover formed with a cavity and upper and lower throughgoing apertures opening into said cavity and both lying on a cavity axis along the periphery of the cover;

a latching member rotatable in said cavity about said axis and having a lower end projecting through said lower aperture and an upper end underneath said upper aperture and formed at said axis with a socket opening toward said upper aperture, said socket and said upper aperture being of similar shape and having like radial extensions;

a ring-shaped support having a seat snugly engageable with said cover and including means having a formation cooperating with said lower end of said latching member for locking said cover and support together in a locking angular position of said latching member relative to said axis and for permitting separation of said cover and support in an angularly offset freeing position of said latching member relative to said support, said extensions being axially and angularly aligned only in said locking position; and a key having a tip of substantially the same cross-sectional shape as said upper aperture and said socket and engageable through said upper aperture into said socket only in said locking position.

2. A latching arrangement, said arrangement comprising:

a cover formed with a cavity and upper and lower throughgoing apertures opening into said cavity and both lying on a cavity axis;

a latching member rotatable in said cavity about said axis and having a lower end projecting through said lower aperture, and an upper end underneath said upper aperture and formed at said axis with a socket opening toward said upper aperture, said socket and said upper aperture being of similar shape and having like radial extensions;

a support having a seat snugly engageable with said cover and including means having a formation cooperating with said lower end of said latching member for locking said cover and support together in a locking angular position of said latching member relative to said axis and for permitting separation of said cover and support in an angularly offset freeing position of said latching member relative to said support, said extensions being axially and angularly aligned only in said locking position; and a key having a tip of substantially the same cross-sectional shape as said upper aperture and said socket and engageable through said upper aperture into said socket only in said locking position, said support having a throughgoing hole through which said lower end of said latching member is engageable, and at said hole is provided with ramps engageable with said lower end, said support being a rim circumferentially surrounding said cover, said rim having an upper face turned toward said cover and a lower face turned away from said cover and having said ramps.

3. The arrangement defined in claim 3 wherein said socket is a groove extending diametrically across said axis, said tip having a pair of oppositely radially extending tongues engageable in said groove.

4. The arrangement defined in claim 4 wherein said tongues have a predetermined height shorter than the axis distance between the upper end of said latching member and said cover at said upper aperture.

5. The arrangement defined in claim 3 wherein said latching member has a relatively wide central region between said apertures of greater size than said apertures.

6. A latching arrangement, said arrangement comprising:

a cover formed with a cavity and upper and lower throughgoing apertures opening into said cavity and both lying on a cavity axis;

a latching member rotatable in said cavity about said axis and having a lower end projecting through said lower aperture and an upper end underneath said upper aperture and formed at said axis with a socket opening toward said upper aperture, said socket and said upper aperture being of similar shape and having like radial extensions;

a support having a seat snugly engageable with said cover and including means having a formation cooperating with said lower end of said latching member for locking said cover and support together in a locking angular position of said latching member relative to said axis and for permitting separation of said latching member relative to said support, said extensions being axially and angularly aligned only in said locking position; and a key having a tip of substantially the same cross-sectional shape as said upper aperture and said socket and engageable through said upper aperture into said socket only in said locking position, a plug having an upper portion complementary to said upper aperture and a lower portion complementary to said socket, and having a height generally equal to the axial distance between the base of said socket and the upper surface of said cover at said upper aperture, whereby said plug can simultaneously fit in said upper aperture and said socket and rotationally lock said latching member in said cover.

7. The arrangement defined in claim 6 wherein said plug is of plastically deformable synthetic-resin material.

8. The arrangement defined in claim 6 wherein said plug is provided with a radially extending formation accessible from above said cover, whereby said plug is removable from said upper aperture and socket by action on said formation of said plug.

9. The arrangement defined in claim 8 wherein said key is provided with a hook engageable under said formation of said plug when same is in said upper aperture and socket and flush with said upper surface.

* * * * *